US008793959B2

(12) United States Patent
Ruland

(10) Patent No.: US 8,793,959 B2
(45) Date of Patent: Aug. 5, 2014

(54) OVERLAP SYSTEM FOR A FLOORING SYSTEM

(75) Inventor: Carl Ruland, Bonn (DE)

(73) Assignee: Novalis Holdings Limited, Hong Kong (CN)

( * ) Notice: Subject to any disclaimer, the term of this patent is extended or adjusted under 35 U.S.C. 154(b) by 0 days.

(21) Appl. No.: 12/773,623

(22) Filed: May 4, 2010

(65) Prior Publication Data

US 2010/0281810 A1 Nov. 11, 2010

Related U.S. Application Data

(60) Provisional application No. 61/176,716, filed on May 8, 2009.

(51) Int. Cl.
*E04B 2/00* (2006.01)

(52) U.S. Cl.
USPC ..... 52/592.1; 52/590.2

(58) Field of Classification Search
CPC ..... E04F 15/02; E04F 15/04; E04F 2201/023; E04F 2201/0115; E04F 2201/0153; E04F 15/02038
USPC ..... 52/592.1, 592.2, 588.1, 582.2, 390
See application file for complete search history.

(56) References Cited

U.S. PATENT DOCUMENTS

| | | | | |
|---|---|---|---|---|
| 152,991 | A | 7/1874 | Hamel | |
| 3,444,660 | A | 5/1969 | Feichter et al. | |
| 6,094,882 | A | 8/2000 | Pervan | |
| 6,363,677 | B1 | 4/2002 | Chen et al. | |
| 6,922,965 | B2 | 8/2005 | Rosenthal et al. | |
| 7,021,018 | B2 * | 4/2006 | Peng | 52/549 |
| 7,155,871 | B1 | 1/2007 | Stone et al. | |
| 7,188,456 | B2 | 3/2007 | Knauseder | |
| 7,516,588 | B2 | 4/2009 | Pervan | |
| 7,543,418 | B2 | 6/2009 | Weitzer | |
| 7,603,826 | B1 | 10/2009 | Moebus | |
| D633,219 | S | 2/2011 | Lai | |
| 8,028,486 | B2 * | 10/2011 | Pervan et al. | 52/588.1 |

(Continued)

FOREIGN PATENT DOCUMENTS

| | | | |
|---|---|---|---|
| JP | 6-313344 | 11/1994 | |
| WO | 94/26999 | 11/1994 | |
| WO | WO 2009142365 A1 * | 11/2009 | E04F 13/14 |

*Primary Examiner* — Brian Glessner
*Assistant Examiner* — Paola Agudelo
(74) *Attorney, Agent, or Firm* — Barley Synder

(57) ABSTRACT

A flooring system employing an improved overlap system for floating installation of flooring panels. Each floor panel having a floor panel body, L-shaped panel sections and L-shaped panel receiving sections. The floor panel body is a multilayered composite structure having a bottom layer. The L-shaped panel sections are prepared on adjacent sides of the floor panel body and include a base section, a vertical support and a cut out section which is formed between the vertical support and the floor panel body. The L-shaped panel receiving sections are prepared on opposite sides of the L-shaped panel sections. The bottom layer of the floor panel has a thickness that is equal to or greater than a height of the L-shaped panel sections and depth of the L-shaped panel receiving sections. Each L-shaped panel receiving section includes a downward facing protrusion and a vertical support receiving passageway, which may engage a cut out section and receive a vertical support from another floor panel respectively. An adhesive is also applied to inner surfaces of the cut out section and vertical support receiving passageway.

25 Claims, 10 Drawing Sheets

(56) References Cited

U.S. PATENT DOCUMENTS

| | | | | |
|---|---|---|---|---|
| 2002/0046526 | A1* | 4/2002 | Knauseder | 52/581 |
| 2002/0189183 | A1* | 12/2002 | Ricciardelli | 52/390 |
| 2003/0093964 | A1* | 5/2003 | Bushey et al. | 52/592.1 |
| 2004/0031226 | A1* | 2/2004 | Miller et al. | 52/588.1 |
| 2004/0031227 | A1* | 2/2004 | Knauseder | 52/592.1 |
| 2004/0035079 | A1 | 2/2004 | Evjen | |
| 2005/0183370 | A1 | 8/2005 | Cripps | |
| 2006/0080910 | A1 | 4/2006 | Cornia | |
| 2006/0260252 | A1 | 11/2006 | Brice | |
| 2006/0260253 | A1* | 11/2006 | Brice | 52/588.1 |
| 2006/0272262 | A1 | 12/2006 | Pomberger | |
| 2007/0011981 | A1* | 1/2007 | Eisermann | 52/588.1 |
| 2007/0175148 | A1* | 8/2007 | Bergelin et al. | 52/480 |
| 2009/0064623 | A1* | 3/2009 | Lee | 52/588.1 |
| 2009/0126308 | A1* | 5/2009 | Hannig et al. | 52/588.1 |
| 2009/0193741 | A1* | 8/2009 | Cappelle | 52/309.1 |
| 2009/0199502 | A1* | 8/2009 | Eisermann | 52/589.1 |
| 2009/0320402 | A1 | 12/2009 | Schacht et al. | |
| 2012/0240502 | A1* | 9/2012 | Wilson et al. | 52/416 |

* cited by examiner

OVERLAP SYSTEM FOR A FLOORING SYSTEM

CROSS-REFERENCE TO RELATED APPLICATIONS

This application is a non-provisional application converted from and claiming the benefit of the filing date under 35 U.S.C. §119(e) of Provisional Patent Application No. 61/176,716, filed May 8, 2009.

FIELD OF THE INVENTION

The present invention relates to a flooring system, and more particularly to a flooring system having individual floor panels incorporating an overlap system for floating installation of one or more individual floor panels.

BACKGROUND

The use of an overlap system for floating installation of flooring is available and readily known. U.S. Pat. No. 7,155,871, as shown in FIGS. 1-4, describes such a known flooring construction that utilizes a floating installation of numerous flooring panels.

The '871 patent describes a floor plank 100 having a top layer 114, a middle layer 116 and a bottom layer 118. Both the top and middle layers 114, 116 are prepared from flexible plastic, wherein the bottom layer 118 is prepared from flexible foam.

The floor plank 100, as a laminate, is prepared from an offset layer arrangement of the different layers. The top layer 114 extends an offset amount "a" beyond a long edge 132 of the middle layer 116 and a short edge 134 of the top layer 114 extends an offset amount "a" beyond a short edge 140 of the middle layer 116 to define an offset L-shaped marginal section 142 of the top layer 114. The marginal offset "a" is described as a matter of design preference, but is preferred to be approximately ¾ of an inch.

Furthermore, a long edge 146 (FIG. 1) of the middle layer 116 extends an offset amount "a" beyond a long edge 148 of the top layer 114, and a short edge 150 of the middle layer 116 extends an offset amount "a" beyond a short edge 156 of the top layer 114 to define an offset L-shaped marginal section 158 of the middle layer 116.

The L-shaped marginal section 142 of the top layer 114 and the L-shaped marginal section 158 of the middle layer 116 are of identical size and shape.

The floor plank 100 is sufficiently flexible, to conform to typical variations in surface contour of a floor base 102 (FIG. 2) upon which the floor plank 100 is laid. In addition, the flexible foam material of the bottom layer 118 is yieldable to small bumps and other imperfections in the floor base 102 generally referred to as surface irregularities. The bottom foam layer 118 thus enables the floor plank 100 to conform to such surface irregularities and lie flat on the floor base 102.

As shown in FIGS. 3 and 4, during installation of the floor planks 100 in side-by-side and end-to-end relationship, a downwardly directed adhesive surface 172 of the L-shaped marginal section 142 of the top layer 114 is positioned to engage an upwardly directed adhesive surface 174 of the L-shaped marginal section 158 of the middle layer 116 to form the assembly 80 of the floor planks 100. When placing two of the planks 100 together, one of the planks 100 can be angled at approximately 45 degrees with respect to the floor base 102 and onto the corresponding upwardly facing adhesive surface 174 of an adjacent floor plank 100. The floor planks 100 can be installed on the floor base 102 without mastic or an adhesive coating on the floor base 102, and without mastic or adhesive on an undersurface 188 of the bottom foam layer 118. Hence, during installation, the floor planks 100 are thereby assembled using a floating installation of numerous floor planks 100, and can be performed in any desired pattern.

During installation, the aforementioned planks 100 bear the possibility that the axes of two or more adjacent planks may not be properly installed parallel to each other. This creates a potential problem of open seams, which are not only optical defects, but create an issue of functionality for the prepared shiplap. Since open seams will not be tolerated, the plank must be removed. Once the adhesive connects two or more planks, the defective plank must be aggressively pulled from the connecting plank to correct the defective seam. As a result, one or more planks may become damaged resulting from the aggressive separation and minimal rigidity of the shiplap.

Additionally, the only force that holds two or more planks together is the adhesive applied to either the underside or top surface of the overhanging layers. As a result, in areas of high traffic, areas of high dynamic loading, areas of distortion and warping due to uneven and/or oscillating sub-floors the two or more connected planks may not be able to withstand shear forces. This effect is supplemented with an increase in temperature.

SUMMARY

Accordingly, the present invention was devised in light of the problems described above. The invention relates to a flooring system that employs an overlap system for floating installation of flooring panels.

Each floor panel includes an overlap system having a floor panel body, L-shaped panel sections and L-shaped panel receiving sections. The floor panel body is a multilayered composite structure having a bottom layer. The L-shaped panel sections are prepared on adjacent sides of the floor panel body. Each L-shaped panel section includes a base section, a vertical support and a cut out section formed between the vertical support and the floor panel body. The L-shaped panel receiving sections are prepared on opposite sides of the L-shaped panel sections. The bottom layer of the floor panel has a thickness that is equal to or greater than a height of the L-shaped panel sections and depth of the L-shaped panel receiving sections. Each L-shaped panel receiving section includes a downward facing protrusion and a vertical support receiving passageway to engage a cut out section and receive a vertical support from another floor panel respectively. An adhesive is applied to inner surfaces of the cut out section and vertical support receiving passageway.

BRIEF DESCRIPTION OF THE DRAWINGS

The invention will be explained in greater detail with reference to embodiments, referring to the appended drawings, in which.

DETAILED DESCRIPTION OF THE EMBODIMENT(S)

Figure 1:
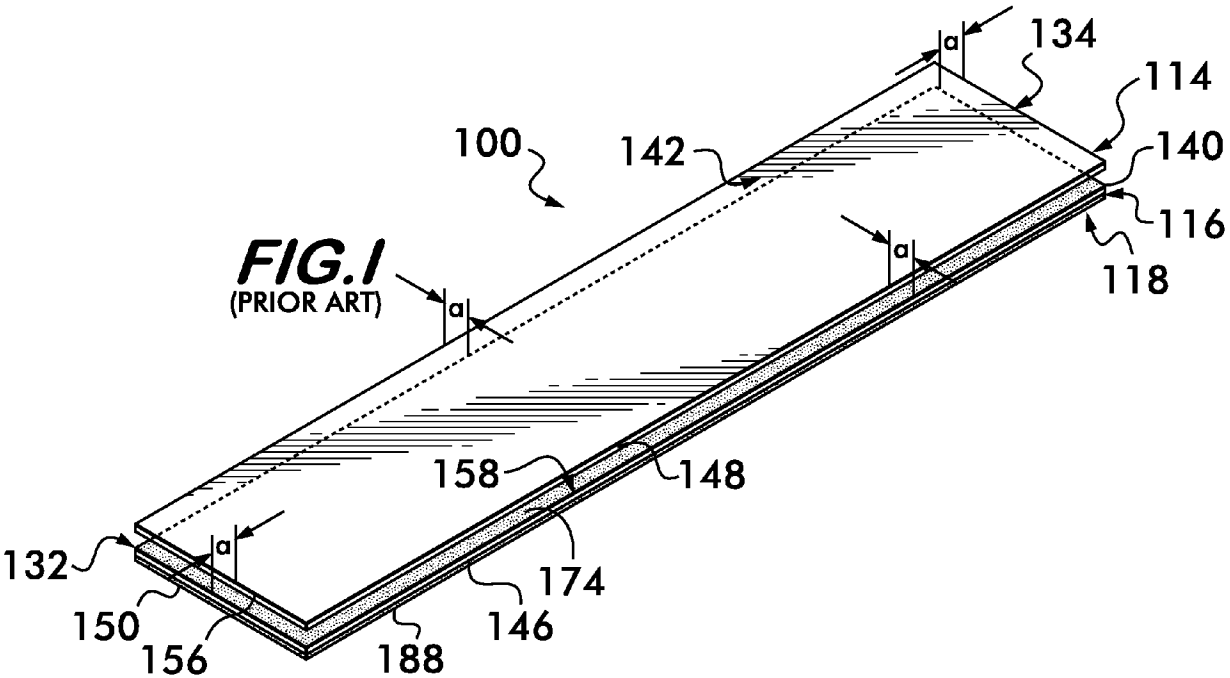
FIG.1 (PRIOR ART)
FIG. 1 is a perspective view of a known floor panel.
Figure 2:
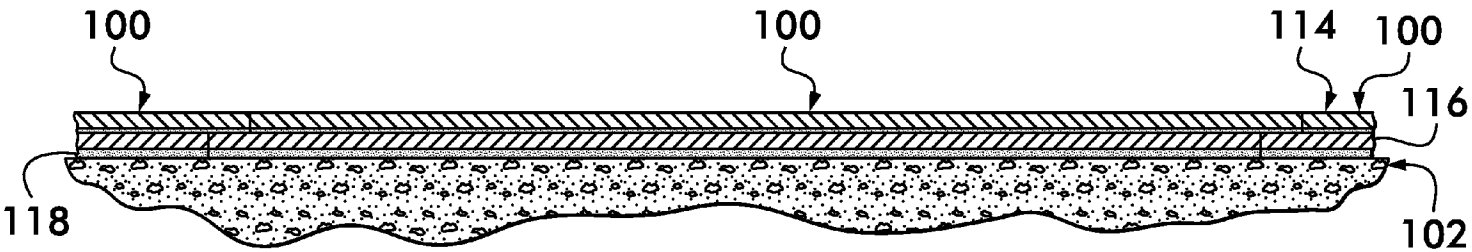
FIG.2 (PRIOR ART)
FIG. 2 is a sectional view of the known floor panel.
Figures 3, 4:
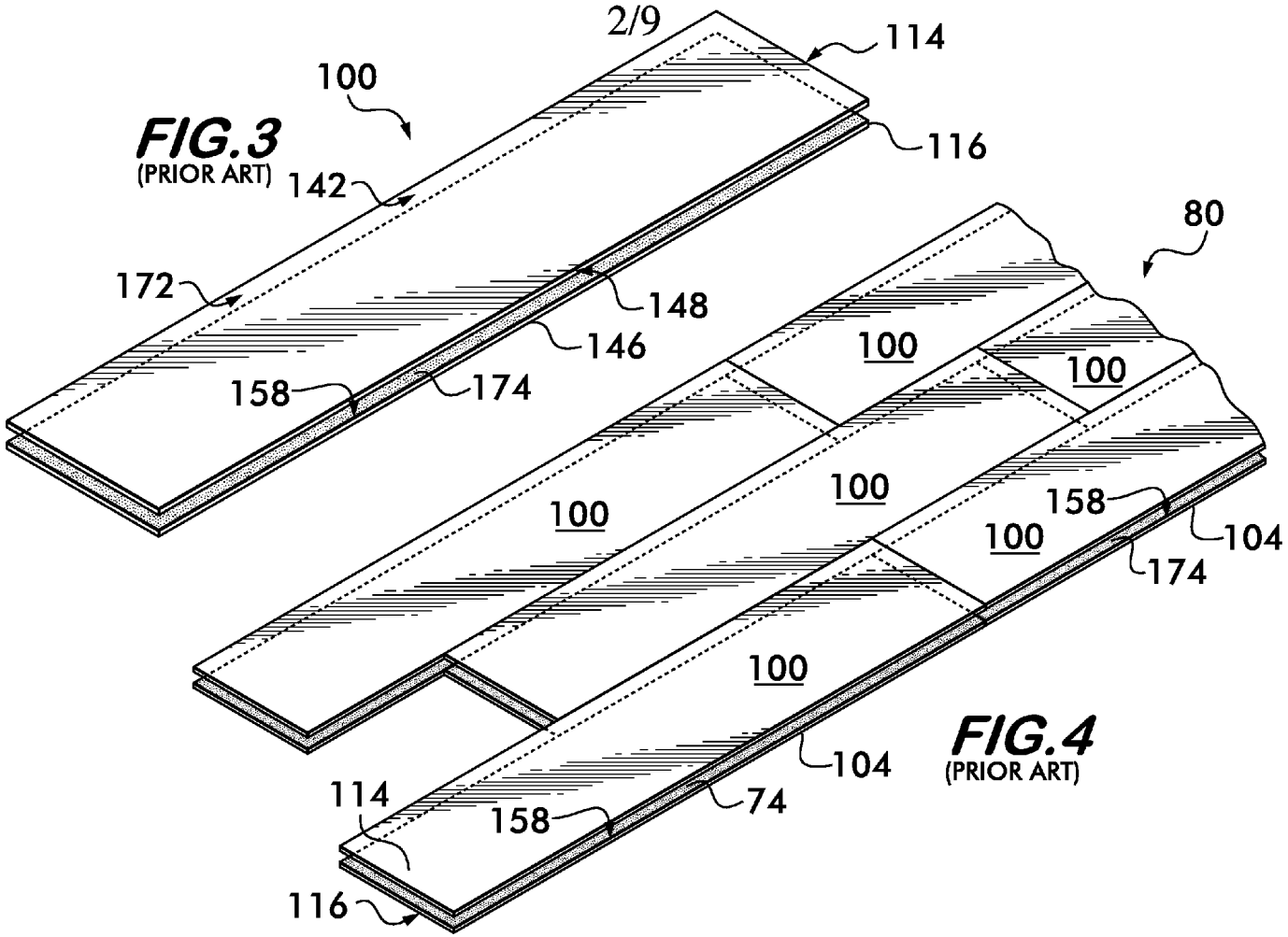
FIG.3 (PRIOR ART)
FIG.4 (PRIOR ART)
FIG. 3 is a perspective view of the known floor panel.
FIG. 4 is a perspective view of the known floor panels installed on an existing floor.

Referring now to the drawings, and like numerals refer to like parts throughout the several views and embodiments.

Figure 5:
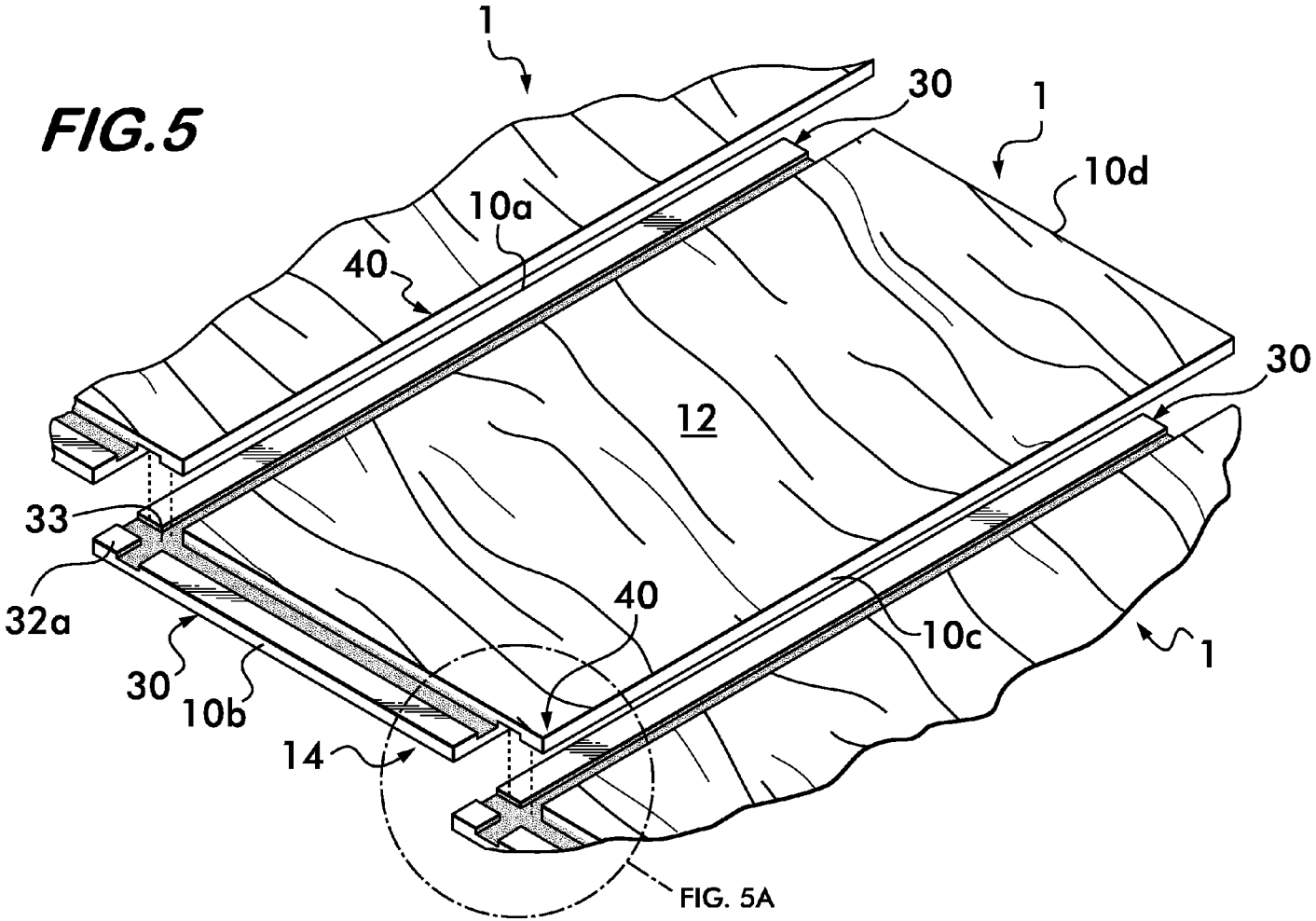
FIG. 5 is a perspective view of a floor panels according to the invention.
Figure 6:
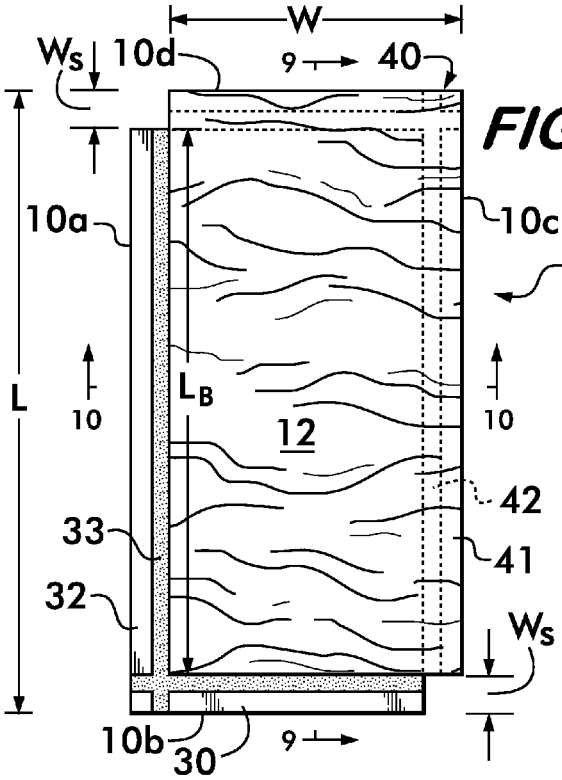
FIG. 6 is a top view of the floor panel according to the invention.
Figure 9:
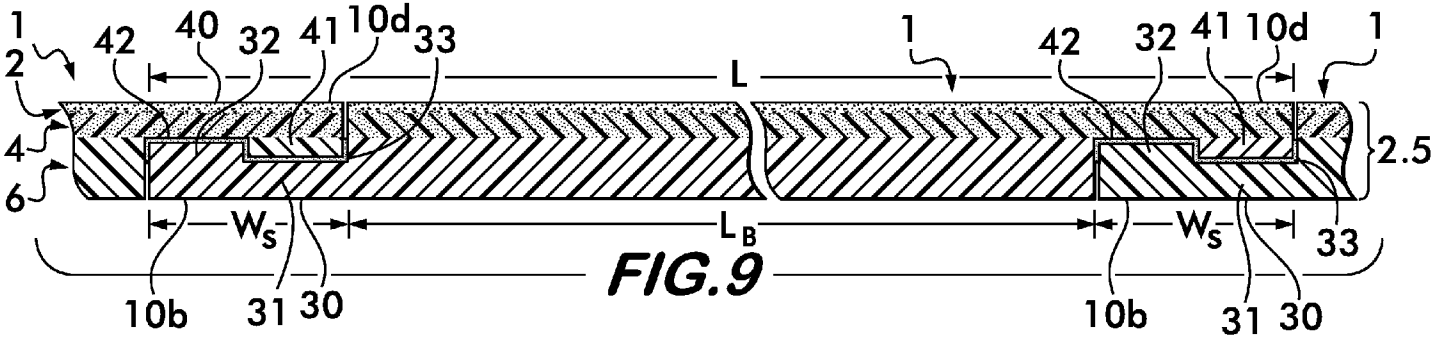
FIG. 9 is a cross sectional view of floor panel along line 9-9 of FIG. 6, according to the invention.

Referring to FIGS. 5, 6, and 9, floor panels 1 are shown. Each floor panel 1 is prepared from laminated components, including polymers, and with several layers forming a monolithic floor covering. The total thickness of each floor panel, in the embodiments shown, is approximately 4-6 mm. However, it is possible to manufacture the floor panels 1 having one or more layers with varying composition, which may include but is not limited to polymers, ceramics, wood, stone, metals, etc.

Figure 10:
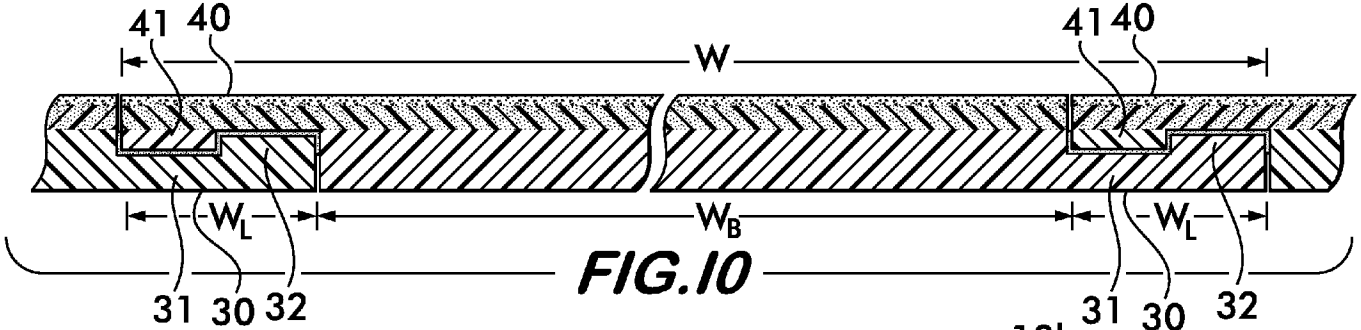
FIG. 10 is a cross sectional view of the floor panel along line 10-10 of FIG. 6, according to the invention.
Figure 14:
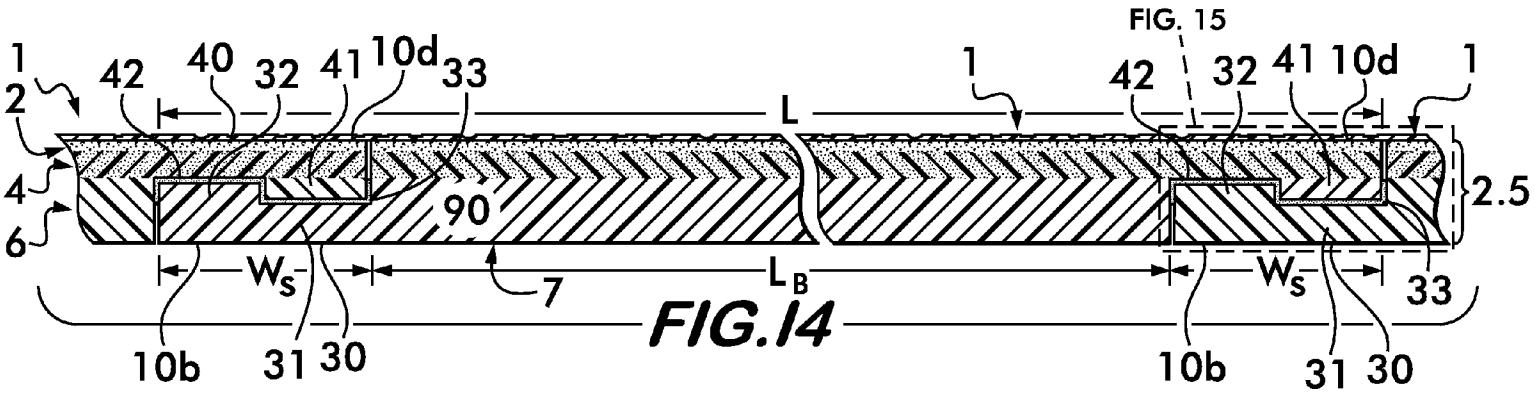
FIG. 14 is a cross sectional of the view floor panel illustrating various layers, according to the invention.

According to the invention, the floor panel 1 is prepared as a laminate having a top layer 2 of sheet material, a middle layer 4 of sheet material, and a bottom layer 6 prepared from a more rigid polymeric material (clearly illustrated in FIGS. 9 and 10). In the embodiments shown, each of the layers 2, 4, and 6 have different thickness, however, it is possible to have layers of equal thicknesses. The thickness, number of layers, type of layering, and overall floor panel 1 manufacturing would accord to final consumer preferences. The manufacturing of the floor panels is not held to one specific design, but rather incorporates the novel design features described in the following paragraphs. It is also possible to add a backing layer 7 (see FIG. 14) to an undersurface of the bottom layer 6.

According to the invention and FIGS. 5 through 6, the floor panel 1, which can be shaped as either a square or rectangle, has four sides 10*a*, 10*b*, 10*c*, 10*d*, wherein each side is connected by interior angles of 90° (right angles). Additionally, the floor panel 1 includes a top side 12 and a bottom side 14. In the embodiment shown, the top side 12 is prepared from the top layer 2, while the bottom side 14 is prepared using the bottom layer 6.

The first and second sides 10*a*, 10*b* include L-shaped panel sections 30, which are used to connect one or more floor panels 1 having corresponding L-shaped panel receiving sections 40 prepared on the sides opposite the L-shaped panel sections 30. In the embodiment shown, the L-shaped panel receiving sections 40 are also on the sides 10*c*, 10*d*.

Figure 7:
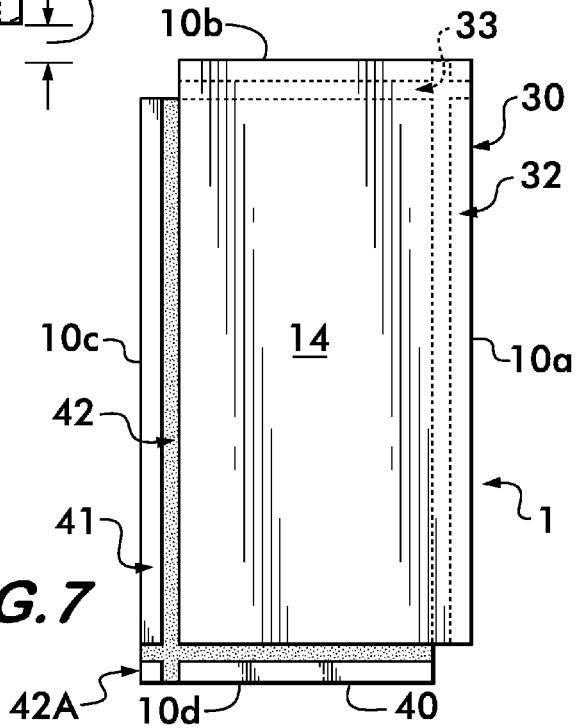
FIG. 7 is a bottom view of the floor panel according to the invention.

When connected to an adjacent floor panel 1, the L-shaped panel receiving section 40 receives and engages with the L-shaped panel section 30 of that adjacent floor panel 1. This union completes the connection of one side of each connecting floor panels 1. Therefore, in the embodiments shown in FIGS. 5-7, the floor panel 1 is prepared having a set of L-shaped panel sections 30 and a set of corresponding L-shaped panel receiving sections 40, wherein each side 10*a*, 10*b*, 10*c*, 10*d* has an arrangement prepared to compliment the opposite side. For instance, if side 10*a* has the L-shaped panel section 30, then side 10*c* may be prepared having the L-shaped panel receiving section 40.

Figure 5A:
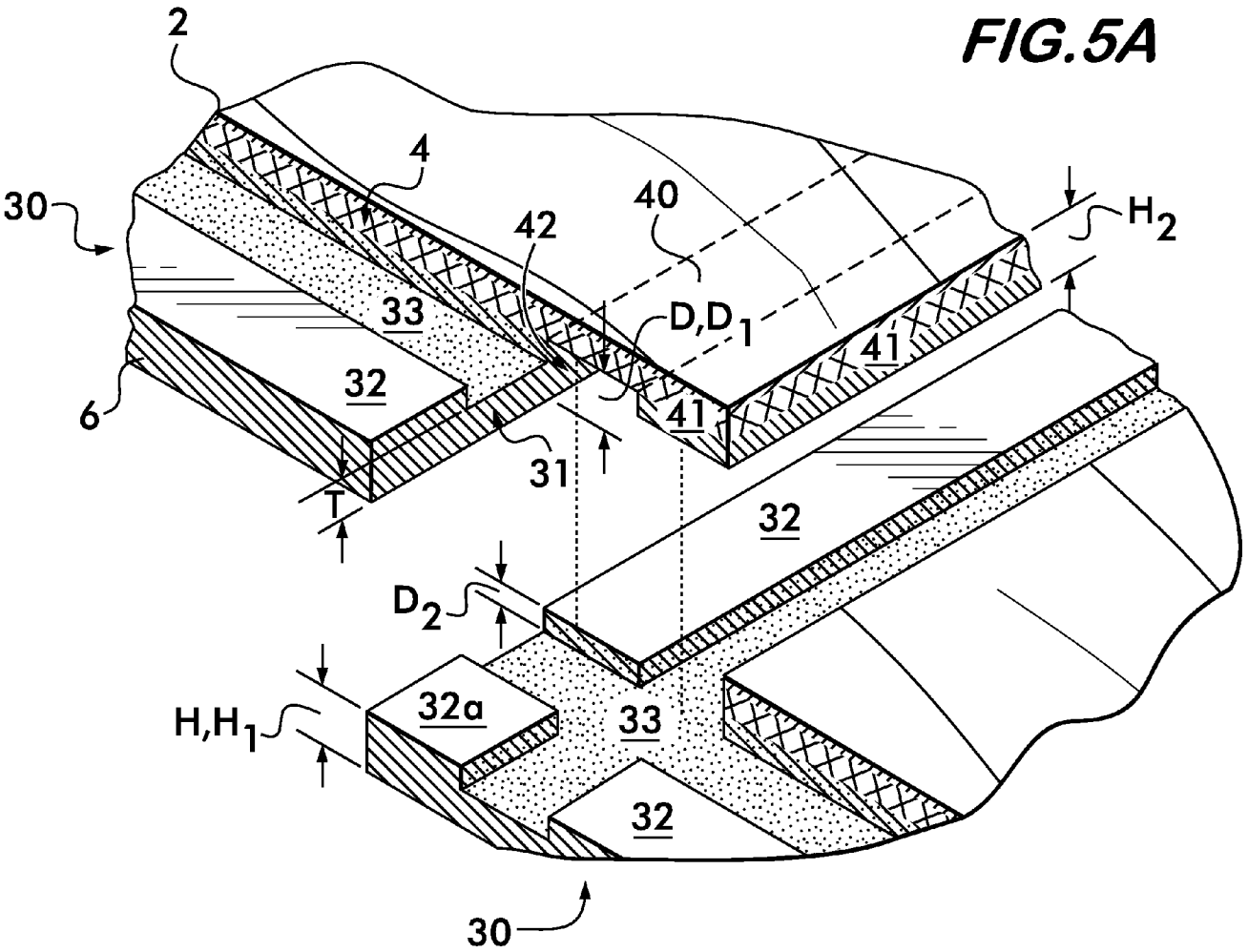
FIG. 5A is an exploded perspective view of connection sections of connecting floor panels according to the invention.

As shown in FIG. 5A, the bottom layer 6 should have a thickness at least equal to a height H of the L-shaped panel section 30, as well as a depth D of the L-shaped panel receiving sections 40. Since the bottom layer 6 is prepared using a rigid material, the overall connection strength, between co joining connection sections 30, 40, is improved. However, it is possible to prepare the floor panel 1 from a single layer, wherein the single layer may be prepared from materials having varying material strength. Therefore, the strength of the connection results from the L-shaped design of each connection section, as well as any adhesive used for installation.

In the embodiment shown in FIG. 5, the floor panel 1 may be prepared having a rectangular shape, wherein two sides 10*b*, 10*d* will be shorter than the adjacent longer sides 10*a*, 10*c*. Therefore, the shorter sides 10*b* and 10*d* will have equal width W, while the longer sides 10*a* and 10*c* will have equal length L.

Figure 5B:
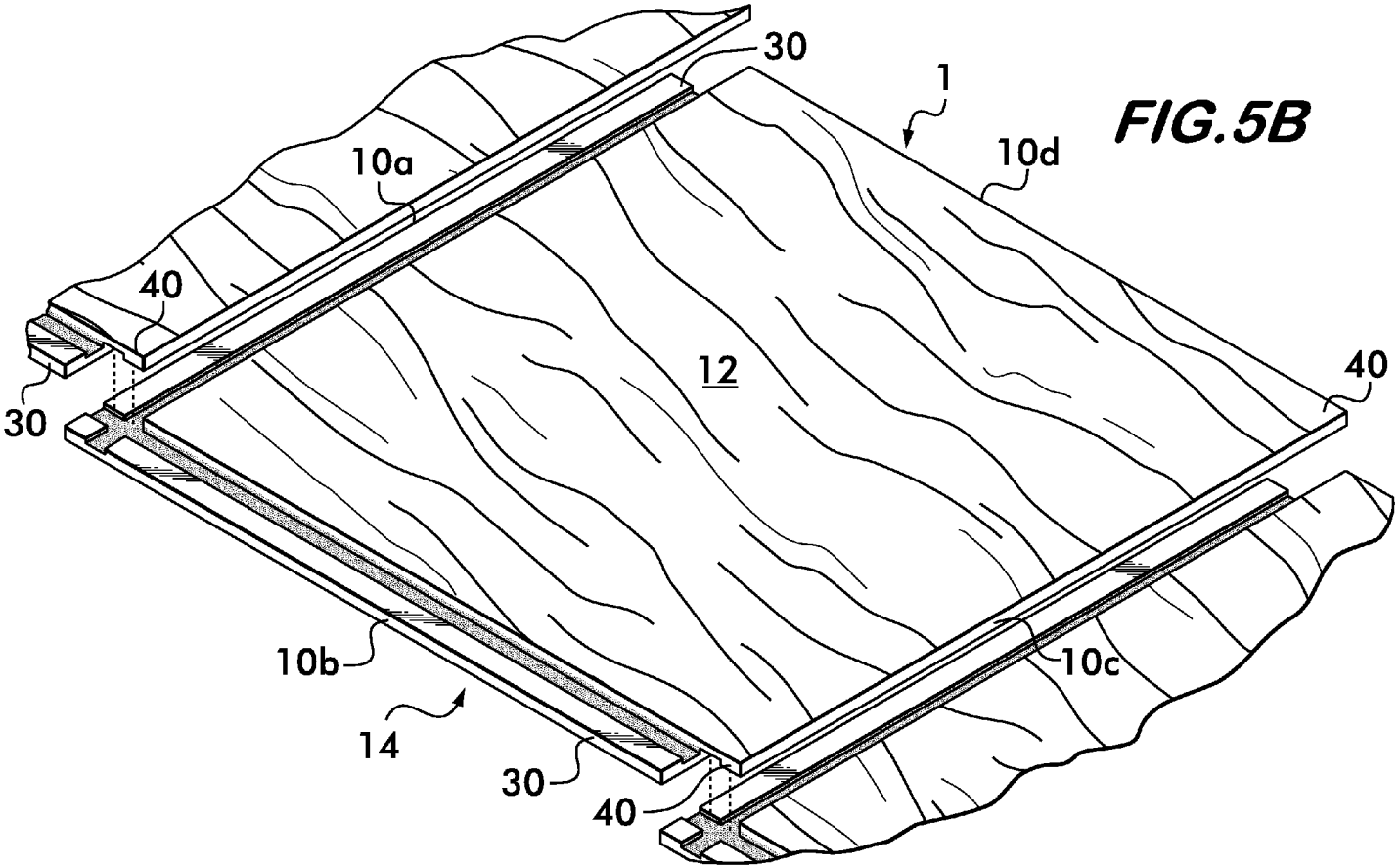
FIG. 5B is a perspective view of an alternative embodiment of floor panels according to the invention.

As alternative, the floor panel 1 may also be prepared having a square shape (see FIG. 5B). Although each side 10*a*, 10*b*, 10*c*, 10*d* would have equal lengths, the sides 10*a*, 10*b*, 10*c*, 10*d* would be prepared having the same connection sections as the floor panel shown in FIG. 5, In light of FIGS. 6 and 9, the length L of the longer sides 10*a*, 10*c* would be equal to a body length $L_B$ of floor panel plus the width $W_S$ of the other set of L-shaped panel sections 30 and L-shaped panel receiving sections 40, which are prepared along the shorter sides 10*b* and 10*d*, respectively. The widths $W_S$ of the L-shaped panel receiving sections 40 and the L-shaped panel sections 30 may also vary, depending on which side 10*a*, 10*b*, 10*c*, 10*d* the L-shaped panel receiving section 40 and the L-shaped panel sections 30 are prepared on. However, as noted above, it is important that the widths $W_S$ of the connecting L-shaped panel receiving section 40 and the L-shaped panel sections 30 be approximately the same.

Additionally, FIG. 10 shows a different cross-sectional view of the same floor panel 1 of FIG. 6, now cut along line 10-10. In light of both figures, the width W of the shorter sides 10*b*, 10*d* are equal to a body width $W_B$ of floor panel plus the width $W_L$ of the L-shaped panel section 30 and the L-shaped receiving section 40, each of which are prepared along longer sides 10*a*, 10*c* respectively. Depending on final manufacturing specifications, the widths $W_L$ of the L-shaped panel receiving section 40 and the L-shaped panel sections 30 may vary. However, the widths $W_L$ of connecting L-shaped panel receiving sections 40 and the L-shaped panel sections 30 should be approximately the same. This enables a uniform and secure connection between connecting floor panels 1.

Referring back to FIGS. 5, 5A and 6, the L-shaped panel section 30, in the embodiment shown, is located or disposed along or in the bottom layer 6. The L-shaped panel section 30 includes a base section 31, a vertical support 32, and cut out section 33. The L-shaped panel receiving section 40 is also located or disposed along or in the bottom layer 6 of the floor panel 1. However, the L-shaped panel receiving section 40 is prepared having a downward facing protrusion 41 and a vertical support receiving passageway 42.

The vertical support 32 of the L-shaped panel section 30 extends vertically from the bottom layer 6 and flat surfaces on all sides. The vertical support receiving passageway 42 is shaped and dimensioned complimentary to the vertical support 32, in order to receive a connecting vertical support 32. In the embodiment shown, the height H of the L-shaped panel section 30 will also be a height $H_1$ of the vertical support 32 and the depth D of the L-shaped panel receiving section 40 is the same as a depth $D_1$ of the vertical support receiving passageway 42. The height $H_1$ of the vertical support 32 and the depth $D_1$ of the vertical support receiving passageway 42 should also be approximately the same. This enables uniform and secure connection between connecting floor panels 1. However, it is possible to prepare a floor panel with a vertical support receiving passageway 42 having a greater depth $D_1$ than height $H_1$ of the vertical support 32.

The overall thickness of the base section 31 will depend on the dimension of the cut out sections 33. In the embodiment shown in FIG. 5B, the depth $D_2$ of the cut out section 33 will equal or be a little greater than the height $H_2$ of the downward facing protrusion 41. As a result, the downward facing protrusion 41 and the cutout section 33 are shaped similarly to correspond with each other for a snug connection. It is also possible to prepare a floor panel with a cut out section 33 having a greater depth $D_2$ than height $H_2$ of the downward facing protrusion 41.

The cut out section 33 extends through the entire L-shaped panel section 30, which has been prepared on side 10*a* (see FIGS. 5 and 6). As a result, the vertical support 32 is established across the outer perimeter of the side 10*a*. The cut out section 33 has a depth $D_2$ measurement shorter than the height $H_1$ of the vertical support 32, and the difference between the $D_2$ and $H_1$ results in the thickness T of the base section 31. The thickness T should be thick enough in order to prevent fracture of the L-shaped panel section 30 from the floor panel body 10.

The cut out section 33 will also extend through the adjacent L-shaped panel section 30, which in the embodiment shown is prepared on side 10*b*. Likewise, the other cut out section 33, prepared on side 10*b*, will extend through the L-shaped panel section 30 on side 10*b*, as well as the L-shaped panel section 30 on side 10*a*. The two cut out sections 33, one on side 10*a* and the other on side 10*b*, form a single standing vertical support 32*a* at the bottom most left corner of floor panel 1 shown.

As best shown in FIG. 6, the vertical support receiving passageway 42, on side 10*c*, also extends along the length of the L-shaped panel receiving section 40, which is prepared on side 10*c* in the embodiment shown. Like the cut out section 33, the vertical support receiving passageways 42 extends through the L-shaped panel receiving section 40 being prepared on side 10*d*. Analogously, the vertical support receiving passageway 42, prepared on side 10*d*, extends along the length of the L-shaped panel receiving section 40 which is prepared on side 10*d*, and through the L-shaped panel receiving section 40 on side 10*c*. Consequently, the two vertical support receiving passageways 42 form another single standing vertical support 42*a* at the top most right corner of floor panel 1 shown.

Figure 12:
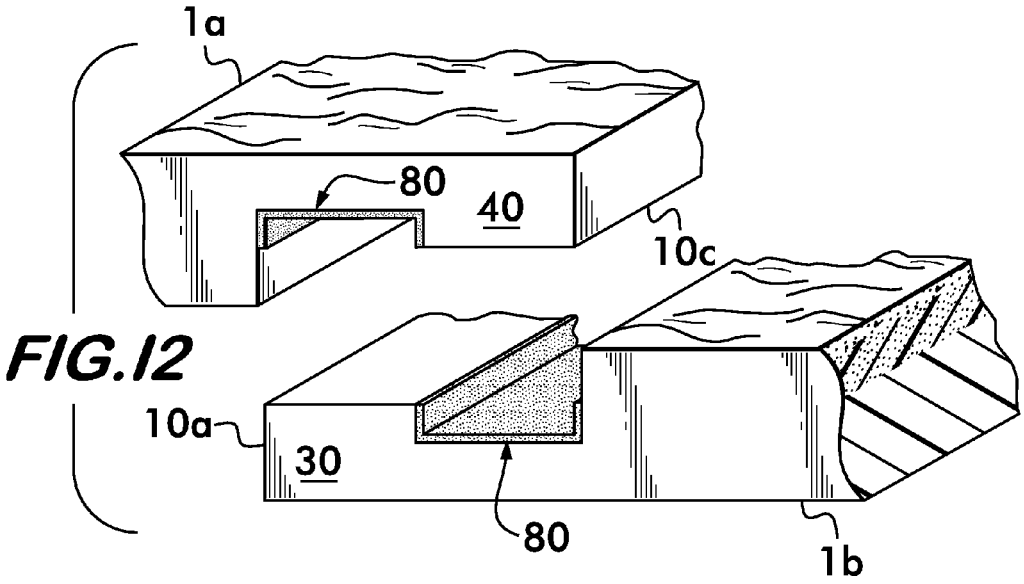
FIG. 12 is a perspective view illustrating one floor panel being connected to another floor panel, according to the invention.

FIG. 12 illustrates the installation of two floor panels 1*a* and 1*b*. As described above, each side 10*a*, 10*b*, 10*c*, 10*d* includes a connection section, either the L-shaped panel section 30 or the L-shaped panel receiving section 40. However, each side will have not have the same connection section as the opposite side. Rather, each side should be prepared to have the connection section that corresponds to the opposite connection section.

In FIG. 12, side 10*c* of the first floor panel 1*a* is prepared having the L-shaped panel receiving section 40, while the second floor panel 1*b* side 10*a* is prepared having the L-shaped panel section 30. Likewise, although not shown, side 10*a* of the first floor panel 1*a* would be prepared having the L-shaped panel section 30, while side 10*c* of the second floor panel 1*b* would be prepared having the L-shaped panel receiving section 40.

During installation, one floor panel 1*b* would lay flat on an existing floorboard (not shown). Subsequent floor panels 1*a* would then be lowered vertically, in such a way that the L-shaped panel receiving section 40, prepared on side 10*c*, is received by the L-shaped panel section 30. The described L-shaped panel section 30 being prepared on side 10*a* of the second floor panel 1*b*. A union between the L-shaped panel section 30 and the L-shaped panel receiving section 40 would connect one side of both floor panels 1*a*, 1*b* in the embodiment shown. As more floor panels are added, each side of the shown floor panels 1*a*, 1*b* may be connected in a similar fashion.

Figure 13:
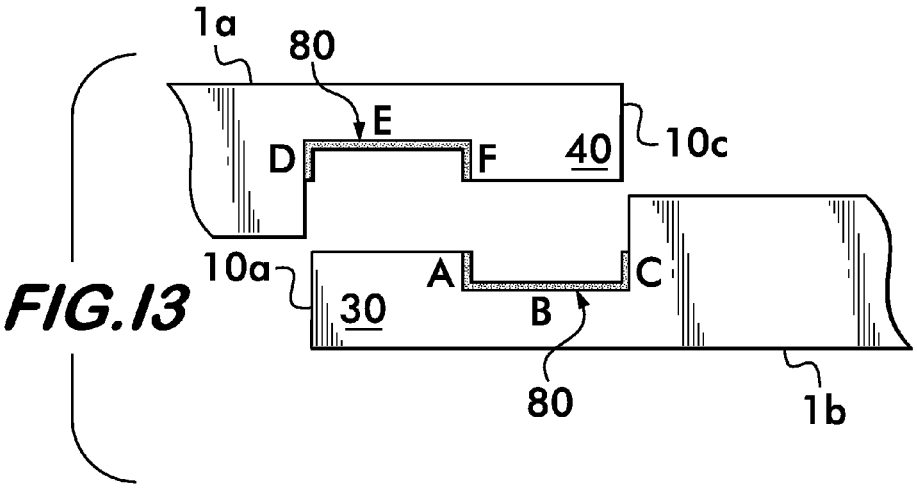
FIG. 13 is a front view illustrating points of adhesive pre-applied to connecting sections of two different floor panels, according to the invention.

In order to maintain connection between two or more connected floor panels 1*a*, 1*b*, an adhesive 80 is pre-applied to each floor panel 1*a*, 1*b*. FIG. 13 illustrates where the adhesive 80 is pre-applied. Within the L-shaped panel section 30, the adhesive 80 is pre-applied to the inner surfaces A, B, C of the cut out section, while also being pre-applied to inner surfaces D, E, F of the vertical support receiving passageway 42. In the embodiment shown, the pre-applied adhesive 80 is uniformly applied along the inner surfaces A, B, C of the cut out section 30 and the inner surfaces D, E, F of the vertical support receiving passageway 42, such that the adhesive 80 has substantially the same thickness along the inner surfaces A, B, C, D, E, F. Furthermore, in the embodiment shown, the adhesive 80 is only applied to a point parallel to major surfaces of the vertical support 32 and downward facing protrusion 41, as well as the single standing vertical support 32*a* and the other single standing vertical support 42*a* formed by the cut out sections 30 and the vertical support receiving passageways 42, respectively. Since the adhesive 80 is only pre-applied to the inner surfaces A, B, C, D, E, and F, the floor panels 1*a*, 1*b* can be handled without unintentionally making contact with the pre-applied adhesive 80.

Figure 8:
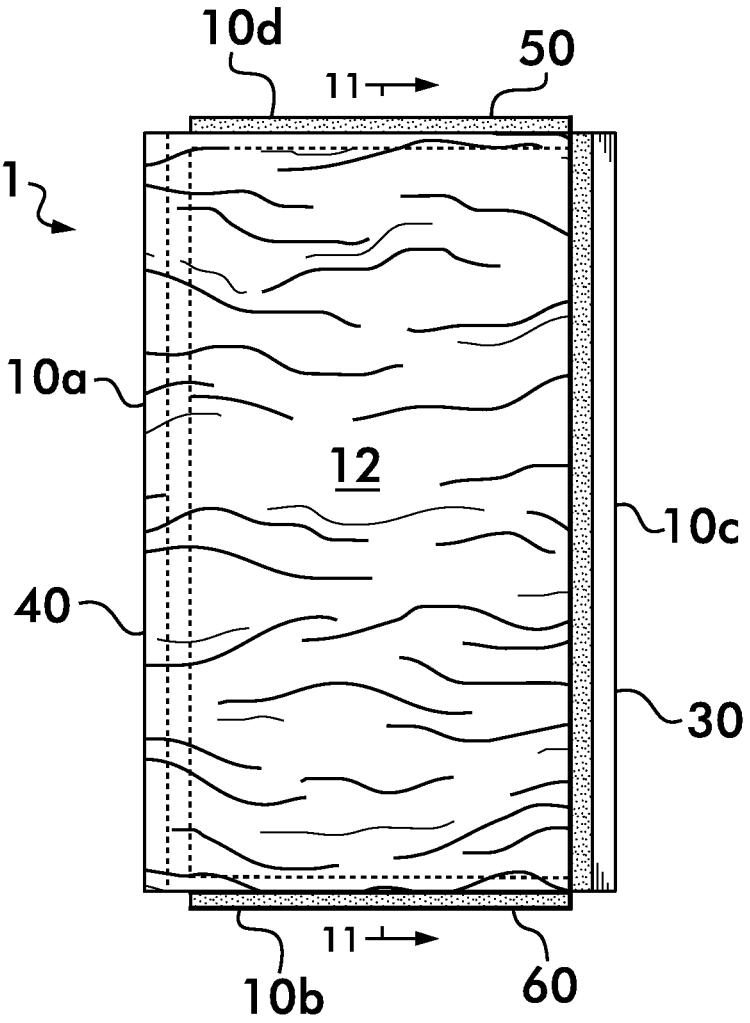
FIG. 8 is a top view of an alternative embodiment of a floor panel according to the invention.
Figure 11:
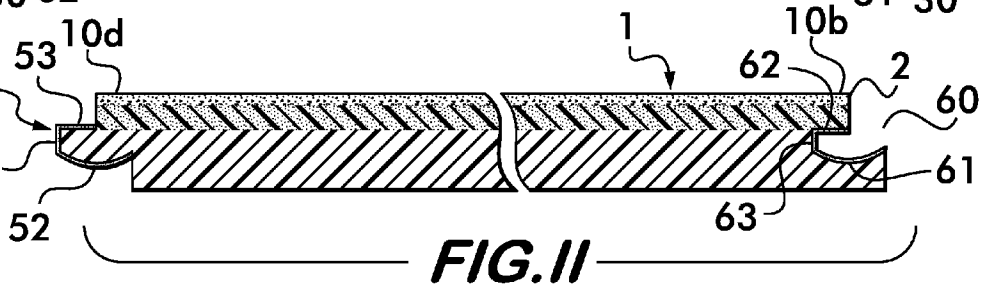
FIG. 11 is a cross sectional view of the alternative embodiment of the floor panel along line 11-11 of FIG. 8, according to the invention.

In another embodiment, shown in FIGS. 8 and 11, the short sides 10*b*, 10*d* of the L-shaped panel sections 30 and the L-shaped panel receiving section 40 are replaced with tongue and groove connection sections 50, 60. The tongue and groove connection sections 50, 60 can be prepared in various shapes, i.e. although the basic shape should include a slot (the groove connection section 60) cut all along one side of the floor panel 1, and a protrusion (the tongue connection section 50) on the opposite side of the floor panel. The tongue connection section 50 should project a little less than the groove connection section 60 is prepared deep.

The tongue connection section 50 is a protrusion prepared on side 10*d* and extending longer than the top layer 2 of the floor panel 1. As best shown in FIG. 11, the tongue connection section 50 has a first locking element 52, which is formed on the lower section of the tongue connection section 50. The first locking element 52 is round shaped having a surface length longer than a top surface 53 of the tongue. Therefore, the first locking element extends into the body of the floor panel 1, as shown. The top surface 53 and the tongue end 54 should be shaped to have a flat surface.

The groove connection section 60 is formed as a recess along side 10*b*. However, the groove connection section 60 extends beyond the peripheral edge of the top layer 2 of the floor panel 1. A second locking element 61, is formed by the recess and having a downwardly concave shape. The dimensions of both the first locking element 52 and the second locking element 61 should be approximately the same in both radii and length. The groove connection section 60 also includes an upper wall 62 and an inner wall 63.

The tongue connection section 50 and the groove connection section 60 are formed to have complimentary shapes, so that when the tongue connection section 50 engages the groove connection section 60 of another floor panel 1, the top surface 53, tongue end 54, and first locking element 52 sit against the upper wall 62, inner wall 63 and second locking element 61 respectively. Since the locking elements 52, 61 are curve shaped, the connection between floor panels 1, in the horizontal direction, is difficult without damaging either floor panel 1.

Since, in the alternative embodiment shown, the shorter sides 10*b*, 10*d* include tongue connection section 50 and the groove connection section 60, installation of two or more floor panels involves angling of the connecting floor panels 1*a*, 1*b* shown in FIG. 12. As discussed previously, a first floor panel 1*b* is laid flat on the existing floor board (not shown). Any floor panels connecting to first floor panel 1*a* along the longer sides 10*a* or 10*c* would install as discussed above wherein the L-shaped panel section 30, prepared on side 10*a* of floor panel 1*b*, would receive the L-shaped panel receiving section 40 prepared on side 10*c* of the connecting floor panel 1*a*. However, any floor panels connecting to the shorter sides 10*b*, 10*d* of the connecting floor panels 1*a*, 1*b* would first have to connect the tongue and groove connection sections 50, 60 first. Consequently, since the tongue and groove connection sections 50, 60 extend in a plane perpendicular to the extension direction of the vertical support 32 and downward facing protrusion 41, another floor panel connecting to the shorter sides 10*b*, 10*d* would first be angled to either accept the tongue connection section 50 (performed by the connecting floor panel groove connection section 60) or penetrate the groove connection section 60 (performed by the connecting floor panel tongue connection section 50). Then the connecting floor panel would be angled to sit planar with the already laid floor panel (in this case either floor panel 1*a* or 1*b*). The shape of the locking elements 52, 61 enables that the connected floor panels will not move and that the connection is secure.

Figure 15:
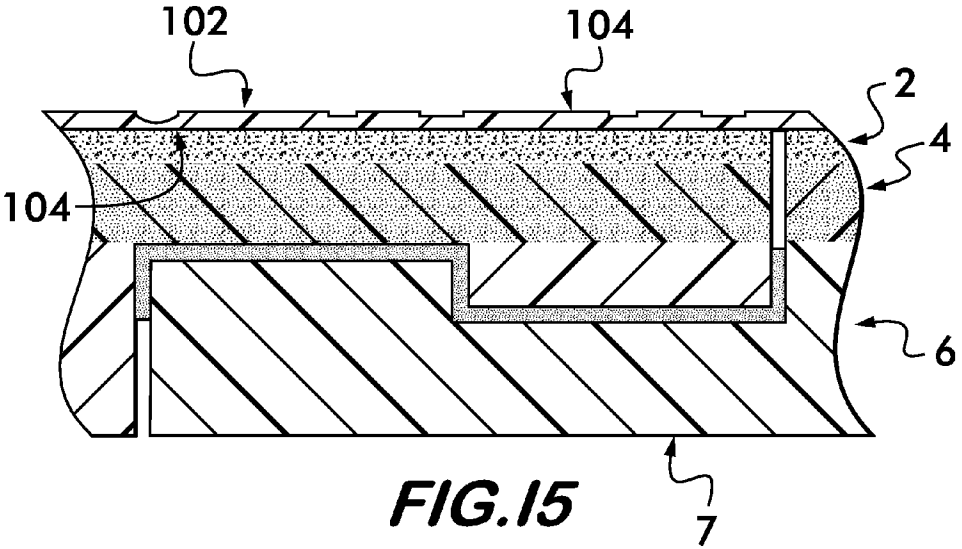
FIG. 15 is an exploded view of the view floor panel illustrating the layering of FIG. 14, according to the invention.

Although the layering and dimensions of the floor panel 1 are a matter of choice, a suitable thickness for the top layer 2, the middle layer 4 and the bottom layer 6 can be for example, 4-6 mm. The top layer 2 is the contact layer, providing wear and texture. As clearly shown in FIGS. 14 and 15, the top layer 2 is prepared from a thin coating layer 102 and a transparent wear layer 104. The thin coating layer 102, although not necessary for construction floor panel 1 construction, would be a polyurethane coating with a thickness around 0.02 mm. However, it would be possible to vary the application, composition, and thickness of the thin coating layer 102 in regard to overall floor panel 1 construction. Additionally, the top layer 2 includes a transparent wear layer 104. The transparent wear layer 104 would be prepared from polyvinyl chloride or other polymeric material such as polypropylene. The wear layer 104 is utilized to protect the middle layer 4, which may be a decorative layer 106. Since the wear layer 104 is transparent or clear, then any aesthetic print on the surface of the middle layer 4 would be visible through the wear layer 104. Although the thickness may vary, the wear layer 104 would be in a range from 0.1-1.0 mm. However, much like the coating layer 102, the application, composition, and thickness of the wear layer 104 may be prepared according to overall floor panel 1 construction The middle layer 4 can be used to provide with printed graphics to enhance the construction of the floor panel 1. Additionally, the middle layer 4 may provide material properties that neither the top or bottom layers 2, 6 may provide, based on material composition. In the embodiment, the middle layer 4 would include a decorative layer 106 (as shown in FIG. 15), having a printed design on a top surface of the decorative layer 106. The thickness of the middle layer 4 can be vary. However, in the embodiment shown, the middle layer 4 is prepared having a decorative layer 106 with a thickness around 0.08 mm. Although the top layer 2 is positioned on top of the middle layer 4, the top layer 2 is transparent allowing any printed pattern on the top surface of the middle layer 4 to be easily seen.

The bottom layer 6, as discussed above, provides rigidity to the connection of floor panels. As a result, in the embodiment shown, the bottom layer 6 should have a thickness at least equal to the connection sections (i.e. the L-shaped panel section 30, L-shaped panel receiving section 40), which may vary. Although the bottom layer 6 thicknesses may vary, it is appropriate to provide the bottom layer 6 having a thickness ranging from 0.5-3.5 mm. As discussed above, a backing layer 7 may be provided to balance the top layer 2. The backing layer 7 could be prepared from a variety of materials, including but not limited to polyvinyl chloride, polypropylene, polyolefin, etc. The backing layer 7 would be utilized to avoid warping which may be caused by the composition and dimensions of the top layer 2.

The foregoing illustrates some of the possibilities for construction and use of the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A floor panel having an overlap system, comprising:

a multilayered composite floor panel body having a top layer, a middle layer of sheet material, and a bottom layer prepared from synthetic polymeric materials;

L-shaped panel sections on adjacent sides of the floor panel body, each L-shaped panel section having a base section, a vertical support with a top planar surface connected to an outside planar surface that extends from the bottom layer, and a cut out section formed between the vertical support and the floor panel body such that adjacent cut out sections on adjacent sides of the floor panel body form a corner vertical support isolated along a corner of the floor panel and positioned separate from the vertical supports by the adjacent cut out sections;

L-shaped panel receiving sections positioned on opposite body sides of the L-shaped panel sections, each of the L-shaped panel receiving sections having a downward facing protrusion with a bottom planar surface connected to a side planar surface that extends from the top layer, and a vertical support receiving passageway such that adjacent vertical support receiving passageways extend through each other and form a second corner vertical support isolated along another corner of the floor panel opposite the corner vertical support; and a pre-applied adhesive disposed along inner surfaces of the cut out section and vertical support receiving passageway extending up to major surfaces of the vertical support and downward facing protrusion;

wherein a combined thickness of the middle and bottom layers are equal to or greater than a height of the L-shaped panel sections and depth of the L-shaped panel receiving sections.

2. The floor panel according to claim 1, further comprising a backing layer positioned along an undersurface of the bottom layer.

3. The floor panel according to claim 1, wherein the floor panel is rectangular.

4. The floor panel according to claim 1, wherein the widths of the L-shaped panel receiving section and the L-shaped panel section are approximately the same.

5. The floor panel according to claim 1, wherein each cut out section of the L-shaped panel sections extend perpendicularly through each other.

6. The floor panel according to claim 1, wherein a height of the vertical support is approximately equal to a depth of the vertical support receiving passageway.

7. The floor panel according to claim 1, wherein a depth of the cut out section is equal or less than a height of the downward facing protrusion such that the height of the downward facing protrusion is fully insertable along the depth of the cut out section.

8. The floor panel according to claim 1, wherein the cut out section has a depth measurement which is less than a height of the vertical support, and the difference between the depth of the cut out section and the height of the vertical support is approximately equal to a base section.

9. The floor panel according to claim 1, wherein the adhesive is applied to a point parallel to the surface of the downward facing protrusion.

10. The floor panel according to claim 1, wherein the downward facing protrusion is prepared from both the middle layer and the bottom layer such that the middle layer extends up to a surface of the vertical support receiving passageway.

11. The floor panel having according to claim 1, the bottom layer is prepared from a more rigid polymeric material than the top layer.

12. The floor panel having according to claim 11, the bottom layer is prepared from a more rigid polymeric material than the middle layer.

13. The floor panel having according to claim 1, wherein the L-shaped panel sections are symmetrically sized and shaped to the L-shaped panel receiving sections.

14. The floor panel having according to claim 1, wherein the pre-applied adhesive is sheet of material having uniform thickness.

15. A floor panel having an overlap system, comprising:

a multilayered composite floor panel body having a top layer, a middle layer and a bottom layer prepared from a polymeric material;

an L-shaped panel section prepared from the bottom layer and having a base section, a vertical support and a cut out section formed between the vertical support and a floor panel body;

an L-shaped panel receiving section prepared from the middle layer and positioned on opposite sides of the L-shaped panel section, the L-shaped panel receiving section having a downward facing protrusion and a vertical support receiving passageway;

a tongue connection section adjacent to the L-shaped panel receiving section and the L-shaped panel section;

a groove connection section positioned opposite to the tongue connection section; and a pre-applied adhesive uniformly disposed along inner surfaces of the cut out section extending up to a major surface of the vertical support and downward facing protrusion;

wherein a thickness of the bottom layer is equal to a height of the L-shaped panel sections and depth of the L-shaped panel receiving sections.

16. The floor panel according to claim 15, wherein the groove connection section is a slot cut along one side of the floor panel.

17. The floor panel according to claim 16, wherein the tongue connection section is a protrusion on a side opposite to the slot.

18. The floor panel according to claim 17, wherein the tongue connection section projects at a length less than a depth of the groove connection section.

19. The floor panel according to claim 15, further comprising:

a first locking element formed on a lower section of the tongue connection section; and a recess formed in the groove connection section.

20. The floor panel according to claim 19, wherein the first locking element is rounded and has a surface length which is longer than a top surface of the tongue, the top surface and a tongue end shaped having a flat surface.

21. The floor panel according to claim 15, wherein the tongue connection section extends further away from the floor panel body than the top layer.

22. The floor panel according to claim 21, wherein the groove connection section extends beyond a peripheral edge of the top layer of the floor panel.

23. The floor panel according to claim 22, further comprising a second locking element formed by the recess and having a downwardly concave shape.

24. The floor panel having according to claim 15, the bottom layer is prepared from a more rigid polymeric material than other layers of the multilayered composite floor panel.

25. The floor panel having according to claim 15, wherein the pre-applied adhesive is sheet of material having uniform thickness.

* * * * *